United States Patent [19]

Nilssen

[11] 4,450,510

[45] May 22, 1984

[54] INCANDESCENT-FLUORESCENT COMPATIBLE LIGHTING PRODUCTS

[76] Inventor: Ole K. Nilssen, Caesar Dr., Rte. 5, Barrington, Ill. 60010

[21] Appl. No.: 365,553

[22] Filed: Apr. 5, 1982

[51] Int. Cl.[3] ..... F21S 3/00

[52] U.S. Cl. ..... 362/221; 339/155 L; 362/228; 362/230; 362/254

[58] Field of Search ..... 339/155; 362/221, 228, 362/254, 230

[56] References Cited

U.S. PATENT DOCUMENTS

| | | | |
|---|---|---|---|
| 3,953,761 | 4/1976 | Giudice | 362/221 |
| 4,318,160 | 3/1982 | Dooley et al. | 362/216 |
| 4,363,083 | 12/1982 | Tanaka et al. | 362/216 |

*Primary Examiner*—Stephen J. Lechert, Jr.

[57] ABSTRACT

Ordinary incandescent lighting products, such as table lamps, floor lamps, ceiling fixtures, etc., are designed to be used with regular screw-in incandescent lamps, and can not be used with non-self-ballasted fluorescent lamps—even if these had been furnished with regular Edison screw-bases. The lighting products of the present invention, however, are capable of being used with either regular incandescent lamps or with screw-base-mounted non-self-ballasted fluorescent lamps.

In one preferred embodiment, the invention is implemented by using an Edison-type lamp socket with three lamp-contacting terminals—such as are commonly used with three-way incandescent lamps. The outer terminal (the one normally connecting with the threaded portion of a regular incandescent lamp) is connected directly with one side of the power line; the middle terminal (the one normally connecting with the middle terminal of a regular three-way incandescent lamp) is connected to the other side of the power line through a current-limiting inductor means; while the center terminal (the one connecting with the center terminal of a regular three-way incandescent lamp) is connected directly to the other side of the power line. Thus, with it mounted on a three-way screw-base with a non-connected center terminal, and having a starter included therewith, a fluorescent lamp can be safely and properly used in a three-way lamp socket—without a chance of being directly subjected to the full non-current-limited line voltage. Also, a regular incandescent lamp can be properly used in the same lamp socket—being thereby automatically connected to the center terminal.

In another preferred embodiment, a high-frequency inverter-type ballast is effectively substituted for the current-limiting inductor means.

10 Claims, 3 Drawing Figures

INCANDESCENT-FLUORESCENT COMPATIBLE LIGHTING PRODUCTS

BACKGROUND OF THE INVENTION

1. Field of the Invention

The present invention relates to portable and fixturable lighting means, particularly of a type capable of being used interchangeably either with incandescent lamps or with non-self-ballasted fluorescent lamps.

2. Cross-reference to Related Applications

The present patent application is partly related to two previous patent applications of mine entitled "Two-Terminal Rapid Start Fluorescent Lamp" (Ser. No. 06/285,943; filed July 23, 1981) and "Fluorescent Lamp Assemblies" (Ser. No. 342,736; filed Jan. 26, 1982.)

3. Description of Prior Art

Fully self-ballasted fluorescent lamps of a type that is capable of being used in ordinary portable and fixtured lighting products with regular Edison screw-in lamp sockets do presently exist, and can in fact be purchased from Westinghouse Electric Corporation, Bloomfield, N.J.

However, to the best of my knowledge, there presently exist no lighting products of a type that is capable of being used properly and interchangeably with either regular incandescent lamps or non-self-ballasted fluorescent lamps; nor have such products ever been described in literature known to me.

SUMMARY OF THE INVENTION

Objects of the Invention

One object of the present invention is that of providing for portable as well as fixturable lighting products that can properly and interchangeably be used either with regular incandescent lamps or with non-self-ballasted fluorescent lamps.

This as well as other objects, features and advantages of the present invention will become apparent from the following description and claims.

Brief Description

The present invention relates to the concept of providing portable and fixturable lighting products that may be used interchangeably with either regular incandescent lamps or with non-self-ballasted fluorescent lamps.

In one preferred embodiment, this incandescent-fluorescent compatibility is accomplished by using in the lighting product an Edison-type of screw-in lamp socket with three lamp-contacting terminals—such as would be used with conventional three-way incandescent lamps. This socket's outer terminal (the one normally connecting with the threaded portion of a regular incandescent lamp) is connected directly with one side of the power line; its middle terminal (the one normally connecting with the middle terminal of a regular three-way incandescent lamp) is connected to the other side of the power line through a current-limiting inductor means; while its center terminal (the one connecting with the center terminal of a regular three-way incandescent lamp) is connected directly to the other side of the power line. Thus, with it mounted on a three-way screw-base, with a non-connected center terminal and with a built-in starter, a fluorescent lamp can be safely used in a three-way lamp socket—without a chance of being directly subjected to the full non-current-limited line voltage. Also, a regular incandescent lamp can be used in the same lamp socket—being thereby automatically connected to the center terminal.

In another preferred embodiment, a high-frequency inverter-type ballast is effectively substituted for the current-limiting inductor means.

DESCRIPTION OF THE PREFERRED EMBODIMENT

Figure 1:
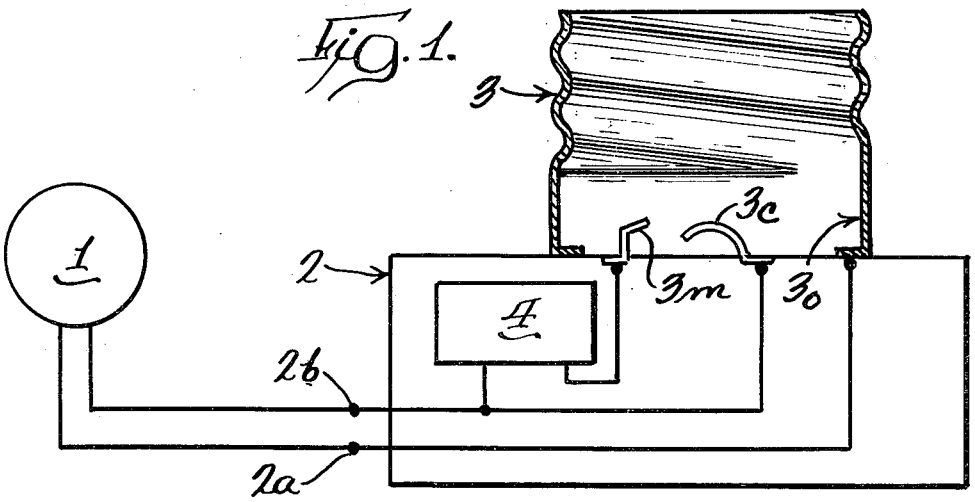
FIG. 1 shows a schematic circuit diagram of the preferred embodiment of the invention as adapted to operate with a regular choke-type of ballast.

The preferred embodiment of the present invention is schematically illustrated by FIG. 1.

Shown in FIG. 1 is a source 1 of AC voltage, which voltage source may be an ordinary household electric power line. The output from source 1 is applied to the two input terminals 2*a* and 2*b* of a housing means 2. Fastened to this means is a lamp socket 3, which socket has three lamp-contacting electrodes: a threaded outer electrode 3*o*, a middle electrode 3*m*, and a center electrode 3*c*. Input terminals 2*a* and 2*b* are connected directly to socket electrodes 3*o* and 3*c*, respectively. Socket electrode 3*m* is connected with input terminal 2*b* by way of a current-limiting inductor means 4, which inductor means is located within said housing means 2.

Figure 2:
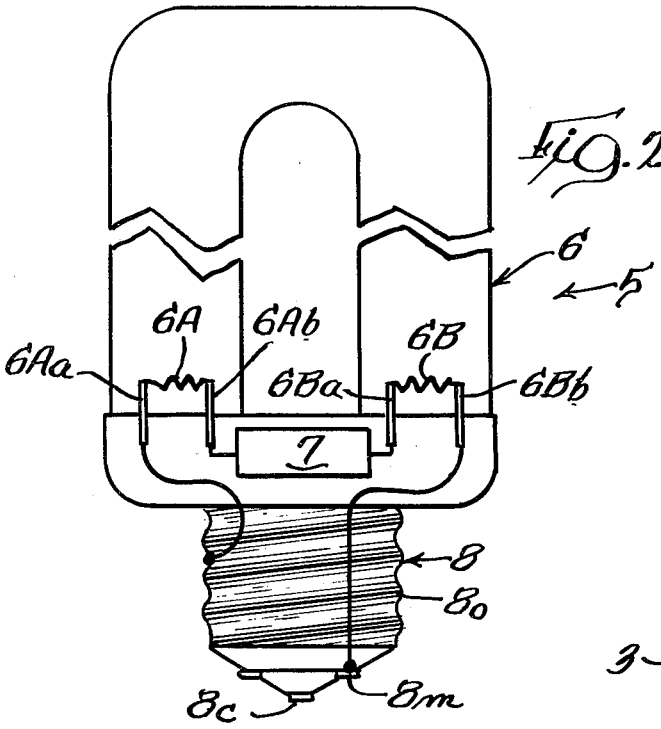
FIG. 2 shows details of a fluorescent lamp adapted to be used with the embodiment of FIG. 1.

FIG. 2 illustrates a fluorescent lamp assembly 5 adapted to be screwed into and properly used in the lamp socket of the preferred embodiment of FIG. 1. This assembly consists of a U-shaped pre-heat fluorescent lamp 6 and a fluorescent lamp starter 7, both of these being mounted on an ordinary three-way lamp base 8 (the kind of base used with ordinary three-way incandescent lamps). Lamp 6 has two cathodes: cathode 6A with input terminals 6A*a* and 6A*b*, and cathode 6B with input terminals 6B*a* and 6B*b*. Connected between terminals 6A*b* and 6B*a* is the lamp starter 7. Lamp base 8 has three terminals: a threaded outer terminal 8*o*, a middle terminal 8*m*, and a center terminal 8*c*. Cathode input terminal 6A*a* is connected directly to outer lamp base terminal 8*o*; cathode input terminal 6B*b* is connected directly with middle lamp base terminal 8*m*; while center lamp base terminal 8*c* is left non-connected.

Lamp assembly 5, by way of its base 8, is adapted to be screwed into lamp socket 3 of FIG. 1. When base 8 is in place in lamp socket 3, base terminals 8*o*, 8*m*, and 8*c* make contact with socket electrodes 3*o*, 3*m*, and 3*c*, respectively.

With reference to FIG. 2, the operation of the arrangement of FIG. 1 may be explained as follows. With fluorescent lamp assembly 5 inserted into socket 3, electrical connections are completed between the fluorescent lamp, the inductor means, and the AC voltage source; and thus the fluorescent lamp will start and operate in the usual manner. With an ordinary incandescent lamp in the socket instead (such a lamp having both an outer and a center electrode, but no middle electrode, on its base), electrical connections are completed directly between the lamp and the AC voltage source;

which therefore provides for the incandescent lamp to operate in the usual manner.

In other words, due to the non-connection of the center electrode on the fluorescent lamp base, the source of AC voltage is prevented from being directly connected to the fluorescent lamp; yet, by way of the middle electrode on its base, the fluorescent lamp is disposed to connect with the power line by way of the inductor means, thereby being disposed to operate properly when placed in the socket.

On the other hand, due to the absence of a middle electrode on the base of an ordinary incandescent lamp, the incandescent lamp will not make connection with the inductor means; yet, because it does have a center electrode on its base, the incandescent lamp is disposed to make direct contact with the power line voltage, thereby also being disposed to operate properly when placed in the same socket.

Figure 3:
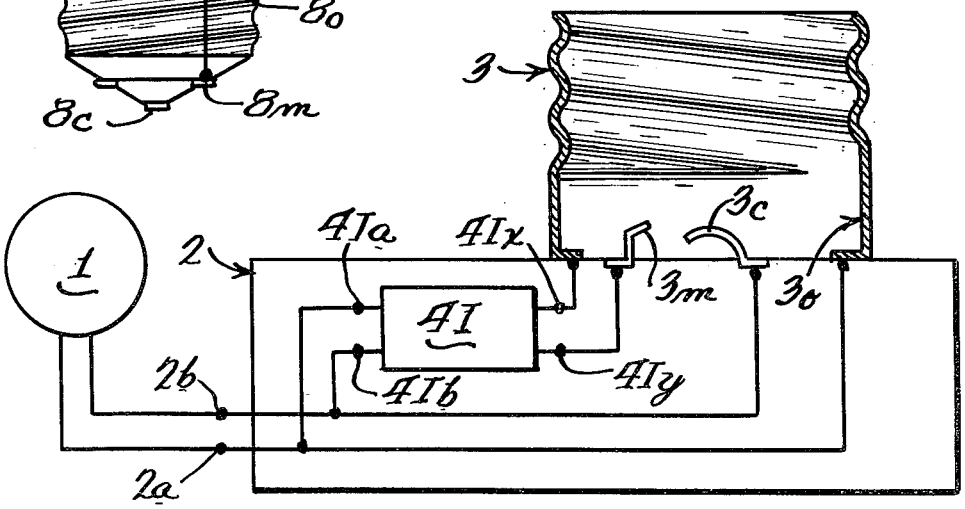
FIG. 3 shows a variation of the preferred embodiment adapted for operation with a high-frequency inverter-type ballast.

Another preferred embodiment is illustrated in FIG. 3. The arrangement of FIG. 3 is essentially identical to that of FIG. 1, except that the inductor means 4 has been substituted with a high-frequency inverter-type ballast means 4I, which high-frequency ballast means has two power input terminals, 4I*a* and 4I*b*, and two output terminals, 4I*x* and 4I*y*, with input terminal 4I*a* being connected or connectable with output terminal 4A*x*. Otherwise, the alpha-numeric designations of FIG. 3 have the same meanings as the corresponding designations of FIG. 1.

The arrangement of FIG. 3 operates in a manner completely analogous to that of FIG. 1. However, due to the higher frequency provided for the fluorescent lamp, different types of fluorescent lamp assemblies may be used. For instance, it would be possible to use fluorescent lamp assemblies of the types disclosed in the previously cited patent applications of mine.

I believe that the present invention and its several attendant advantages and features will be understood from the preceeding description. However, without departing from the spirit of the invention, changes may be made in its form and in the construction of its component parts; the form herein presented merely representing its peferred embodiment.

I claim:

1. A lighting product adapted to connect with a pair of regular electric utility power lines and to receive, hold, and power a fluorescent lamp or, alternately and interchangeably, an incandescent lamp, said fluorescent lamp having a first and a second fluorescent lamp contact means, said incandescent lamp having a first and a second incandescent lamp contact means, said product comprising:

a socket adapted to receive and hold either the fluorescent lamp or, alternately and interchangeably, the incandescent lamp and having a first, a second, and a third socket contact means, said first and second socket contact means being adapted to make contact with said first and second fluorescent lamp contact means whenever said fluorescent lamp is inserted into the socket, said first and third socket contact means being adapted to make contact with said first and second incandescent lamp contact means whenever an incandescent lamp is inserted into the socket, a fluorescent lamp ballasting means, and connection means adapted to connect said first socket contact means directly with one of said pair of electric utility power lines, said second socket contact means indirectly by way of said ballasting means with the other one of said pair of electric utility power lines, and said third socket means directly with said other one of said pair of electric utility power lines, whereby: whenever the fluorescent lamp is placed into the socket, it gets powered from the power line by way of the ballasting means; but, whenever the incandescent lamp is placed into the lamp socket, it gets powered directly from the power line.

2. The lighting product of claim 1 wherein said socket is adapted to receive and hold a lamp with an ordinary Edison-type screw-base.

3. The lighting product of claim 1 wherein said ballasting means comprises an inverter means.

4. A lighting product adapted to connect with a pair of regular electric utility power lines and to receive, hold, and operate an incandescent lamp or, alternately and interchangeably, a fluorescent lamp, each lamp being mounted on a base with a first, a second, and a third terminal, the incandescent lamp being connected between the first and the second terminal of its base, the fluorescent lamp being connected between the first and the third terminal of its base, the lighting product comprising:

a socket adapted to receive, alternately and interchangeably, either of said lamps and having a first, a second, and a third electrode, said electrodes respectively adapted to make contact with the first, the second, and the third lamp base terminal, a fluorescent lamp ballasting means, and connection means by which to connect said first socket electrode to one of said pair of power lines, said second socket electrode to the other one of said pair of power lines, and said third socket electrode to said other one of said pair of power lines by way of said ballasting means, whereby, when the incandescent lamp is placed in the socket it gets connected directly across the power line, but when the fluorescent lamp is placed in the socket it gets connected to the power line by way of the ballasting means.

5. The lighting product of claim 4 wherein said socket is adapted to receive ordinary Edison-type screw-in lamp bases.

6. The lighting product of claim 4 wherein said ballast means comprises an inverter means.

7. A fluorescent lighting system adapted to be powered from a pair of electric utility power lines and comprising:

a fluorescent lamp mounted on a base having a first and a second base terminal, a lamp socket means adapted to receive and hold said fluorescent lamp and having a first, a second, and a third electrode, said first and second electrode adapted to make contact, respectively, with said first and second base terminal, said lamp socket also adapted to receive and hold a two-terminal incandescent lamp and to make contact with said incandescent lamp though its first and third electrode, a fluorescent lamp ballasting means, and connection means by which to connect said first socket electrode directly to one of said pair of power lines, said second electrode indirectly by way of said ballasting means to the other one of said pair of power lines, and said third electrode directly to said other one of said pair of power lines, whereby, when it is placed in the lamp socket, said fluorescent lamp gets connected to the power line by way of said ballasting means, yet a two-terminal incandescent lamp may also be properly used in said lamp socket means.

8. The lighting system of claim 7 wherein said lamp socket means is adapted to receive and hold a regular Edison-type screw-base incandescent lamp.

9. The lighting system of claim 7 wherein said fluorescent lamp ballasting means comprises an inverter means.

10. The lighting system of claim 7 wherein the base on which said fluorescent lamp is mounted is a regular incandescent-type three-way screw-base and comprises a lamp starter means.

* * * * *